United States Patent [19]

Hahn

[11] Patent Number: 4,723,430

[45] Date of Patent: Feb. 9, 1988

[54] APPARATUS AND METHOD FOR FORMING A SURFACE CONFIGURATION ON A CAN BODY

[75] Inventor: Roger A. Hahn, Arvada, Colo.

[73] Assignee: Adolph Coors Company, Golden, Colo.

[21] Appl. No.: 830,196

[22] Filed: Feb. 18, 1986

[51] Int. Cl.[4] ..... B21D 28/18

[52] U.S. Cl. ..... 72/54; 72/62; 72/58; 72/478; 72/465; 72/370; 29/421 R; 413/73; 413/76

[58] Field of Search ..... 72/54, 57, 58, 59, 60, 72/61, 62, 458, 465, 367, 370, 413, 478; 29/421 R, 157.3 V; 413/73, 71, 76, 69; 425/438, 396

[56] References Cited

U.S. PATENT DOCUMENTS

| | | | |
|---|---|---|---|
| 1,202,775 | 10/1916 | Barr | 72/478 |
| 1,296,106 | 3/1919 | Naylor | 72/478 |
| 2,280,359 | 4/1942 | Trudell . | |
| 2,423,862 | 7/1947 | Vorobik | 72/54 |
| 2,966,872 | 1/1961 | Schmocker | 72/55 |
| 2,966,873 | 1/1961 | Hoffman et al. . | |
| 3,247,548 | 4/1966 | Fields et al. | 425/438 |
| 3,295,347 | 1/1967 | Fuessle et al. | 83/178 |
| 3,564,884 | 2/1971 | Hinshaw | 72/57 |
| 3,687,098 | 8/1972 | Maytag | 113/120 R |
| 3,757,555 | 9/1973 | Blutt et al. . | |
| 3,808,868 | 5/1974 | Wolfe . | |
| 3,951,083 | 4/1976 | Hörtig . | |
| 3,953,994 | 5/1976 | Brawner et al. | 72/58 |
| 3,967,488 | 7/1976 | Hasselbeck et al. . | |
| 4,006,619 | 2/1977 | Anderson | 72/58 |
| 4,070,888 | 1/1978 | Gombas | 72/91 |
| 4,388,752 | 6/1983 | Vinciguerra et al. | 72/58 |

FOREIGN PATENT DOCUMENTS

| | | | |
|---|---|---|---|
| 2706400 | 2/1977 | Fed. Rep. of Germany | 72/61 |
| 56121 | 4/1982 | Japan | 72/62 |
| 740413 | 6/1980 | U.S.S.R. | 83/178 |
| 1007860 | 3/1983 | U.S.S.R. | 72/275 |

OTHER PUBLICATIONS

Metal Box publication, printed in England 1/1982, "160 N".

*Primary Examiner*—Robert L. Spruill
*Assistant Examiner*—David B. Jones
*Attorney, Agent, or Firm*—Klaas & Law

[57] ABSTRACT

A system for forming a surface configuration, such as a neck and a flange, on a can body adjacent an open end thereof using a mandrel having an outer surface comprising generally cylindrical portions on each side of an annular recess which recess has a surface configuration corresponding to the neck and the flange to be formed. A resilient deformable object is located around the mandrel. A portion of a can body is placed between the mandrel and the resilient, deformable object which is then deformed so as to move a portion of the can body into conformation with the surface of the annular recess. At the same time, a force is applied to a portion of the portion of the can body being deformed to resist the movement thereof so that the portion of the can body in which the neck and flange is being formed is stretched and thinned as it is moved into conformation with the surface of the annular recess.

11 Claims, 8 Drawing Figures

APPARATUS AND METHOD FOR FORMING A SURFACE CONFIGURATION ON A CAN BODY

FIELD OF THE INVENTION

This invention relates generally to the manufacture of can bodies for use as containers, such as beverage containers, and more particularly to the portion of the manufacturing operation wherein the portion of a can body adjacent to its open end is subjected to a process for forming a surface configuration on a can body such as a neck and a flange on the can body.

BACKGROUND OF THE INVENTION

In the manufacture of cans for use as containers, such as beverage containers and particularly when the cans are formed from aluminum, it is most desirable to keep the thickness of the material in the can body to an absolute minimum. A problem that is associated with this is that the open can end is not strong enough so that it can be damaged during the manufacturing filling and sealing operations. Accordingly, it is conventional to provide a neck adjacent to the open end of the can body for strengthening purposes and a flange for cooperation with a can lid in the sealing operation.

BRIEF DESCRIPTION OF THE INVENTION

This invention provides a system for forming a surface configuration on a can body, such as a neck and a flange in the portion of a can body adjacent to its open end. In accordance with the invention, a can body is positioned around a mandrel so that a portion of the can body is radially opposite a pair of generally cylindrical surfaces joined by an annular recess in the outer surface of the mandrel. The annular recess has an outer surface configuration corresponding to the surface configuration to be formed on the can body. A resilient, deformable object is positioned around the portion of the can body. A force is applied to the resilient, deformable object so as to deform the resilient, deformable object in a radially inward direction to move the portion of the can body into conformation with the outer surface configuration of the annular recess. At the same time, a force is applied to the portion of the can body to resist the movement thereof so that the portion of the can body is stretched and thinned as it is moved into conformation with the surface of the annular recess. Also, a force is placed on the remaining portion of the can body to prevent movement thereof.

In a preferred embodiment of the invention which is directed to the formation of a neck and a flange on a can body, a conventional starwheel having a plurality of spaced apart work stations located around its periphery is rotated about an axis so that an unnecked and unflanged can enters one work station at one location and exits as a necked and flanged can from the same work station at another location. Each unnecked and unflanged can body is fed into a starwheel work station and positioned on a vacuum chuck locator. A collapsible mandrel is mounted in a fixed position in each work station. The collapsible mandrel in its expanded operational condition has an outer surface having a pair of generally cylindrical portions with an annular recess therebetween. The collapsible mandrel is normally resiliently urged into a collapsed condition. A resilient, deformable object is mounted to surround the mandrel with portions of the resilient, deformable object radially opposite the pair of generally cylindrical portions and the annular recess of the mandrel. As the work station rotates, means are provided to move the can body into and out of a location around the mandrel and within the resilient, deformable object at which location the portion of the can body adjacent an open end thereof is radially opposite the pair of generally cylindrical portions and the annular recess of the mandrel and the portions of the resilient, deformable object. Means are provided on each work station so that as the work station rotates, the means are moved into and out of a location wherein the means function to expand the collapsible mandrel into its operational condition. When the mandrel is in its operational condition, a portion of the portion of the can body immediately adjacent the open end is clamped between one of the cylindrical portions of the mandrel and the inner surface of a rigid element adjacent to the resilient deformable object. As the work station rotates, means are provided to provide a force on the resilient, deformable object so as to deform at least a portion of the resilient, deformable object in a radially inward direction into contact with the portion of the can body. Sufficient force is applied to deform the resilient, deformable body so that the portion of the can body is moved in a radially inward an axial direction into conformation with the surface of the annular recess. The clamping force being applied by the mandrel functions to stretch and thin the portion of the can body as it is moved into conformation with the surface of the annular recess. At the same time, another portion of the resilient, deformable object is moved into contact with a portion of the remaining portion of the can body to apply a force thereto and clamping it between the another portion of the resilient, deformable object and the other cylindrical portion of the mandrel to prevent any movement of the remaining portion of the can body.

It is an object of this invention to provide a system for forming a surface configuration on the portion of a can body adjacent to an open end thereof while stretching and thinning that portion.

Additional objects, advantages and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DETAILED DESCRIPTION OF THE INVENTION

Figure 1:
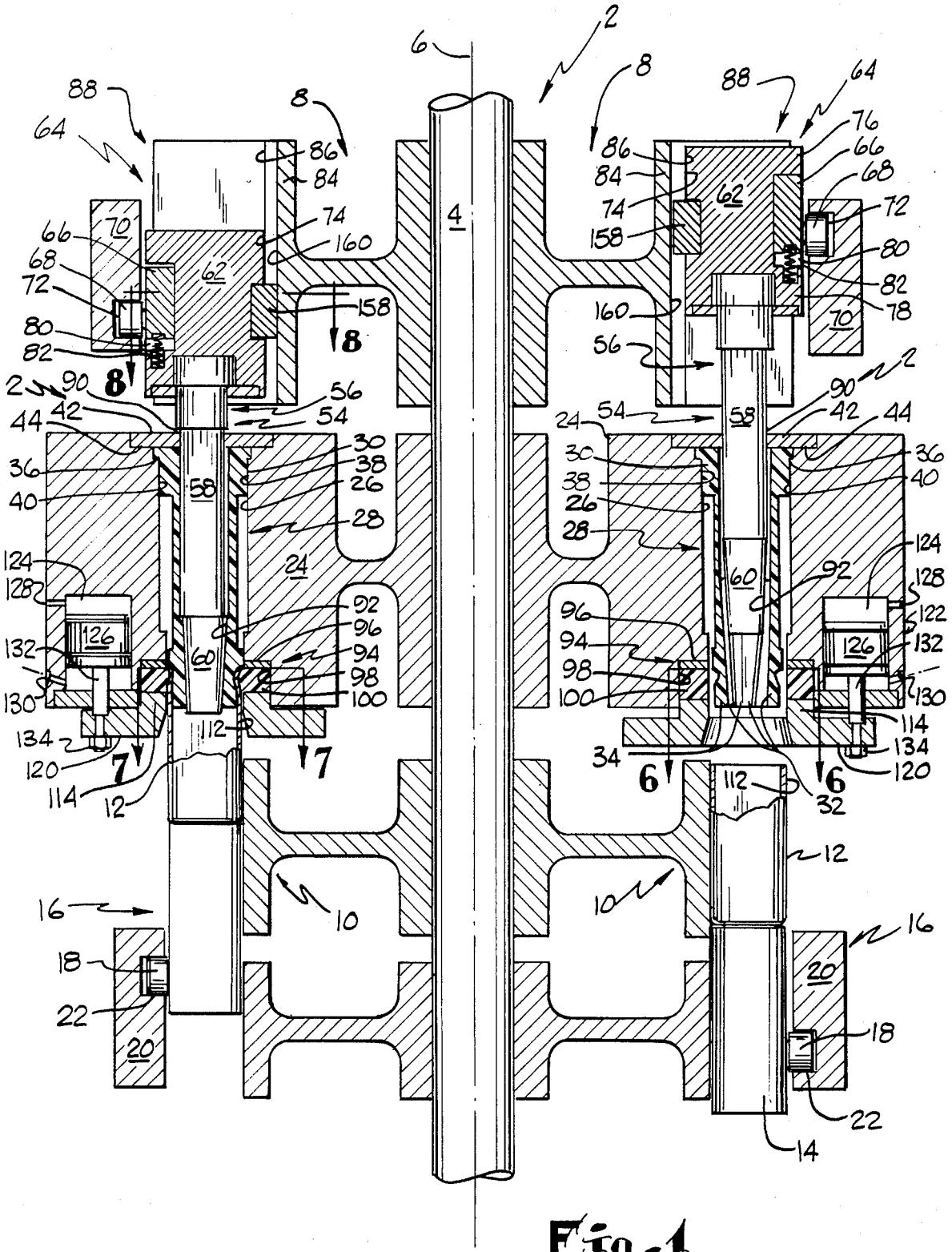
FIG. 1 is a schematic illustration of a preferred embodiment of the invention.

A preferred embodiment of the invention is schematically illustrated in FIG. 1 and comprises a starwheel 2 secured to a shaft 4 for rotation therewith around the longitudinal axis 6 of the shaft 4. In FIG. 1, the longitudinal axis 6 extends in a vertical direction, but it is understood that this is for illustration purposes only and that the longitudinal axis 6 may extend in other directions within the spirit of this invention. The starwheel 2 has a plurality of circumferentially spaced apart work stations 8, generally about eight in number (not shown). Each work station 8 has a pocket means 10 for receiving a can body 12 and a vacuum chuck locator means 14. Means 16 are provided for reciprocating the vacuum chuck locator means 14 and, therefore, the can body 12 in directions generally parallel to the longitudinal axis 6. The means 16 comprises a rotatable cam follower 18 mounted on the vacuum chuck locator means 14 and a barrel cam 20 having a cam surface 22 for guiding the movement of the rotatable cam follower 18.

A block 24 is mounted in a fixed position on each work station 8. The block 24 has a bore 26 extending therethrough with the bore 26 having a longitudinal axis extending in a direction generally parallel to the longitudinal axis 6. A collapsible mandrel 28 is located in the bore 26 and comprises a body portion 30 and a plurality of fingers 32 and 34 projecting therefrom. The body portion 30 is seated in a recess 36 and has an outer surface 38 in contact with the inner surface 40 of the bore 26. In the preferred embodiment of the invention, the outer surface 38 and the inner surface 40 are generally cylindrical but can be of other configurations. A plate 42 secured in a recess 44 in the block 24 by suitable means, such as a threaded connection, securely positions the body portion 30 in the recess 36.

Figure 6:
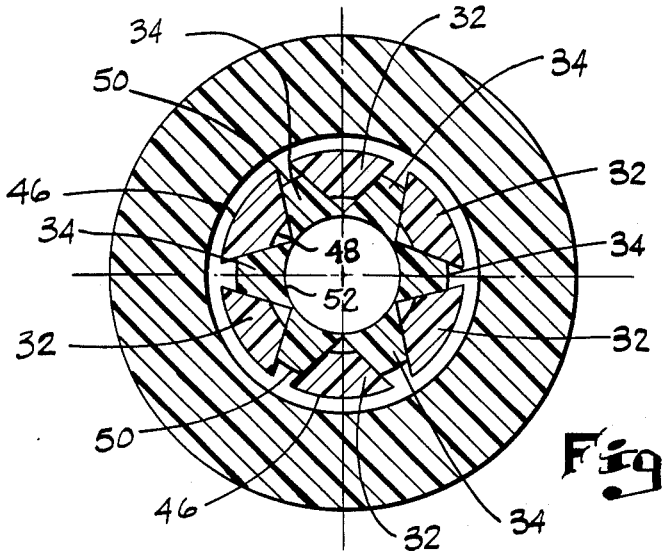
FIG. 6 is a plan view looking down from the line 6—6 on FIG. 1.
Figure 7:
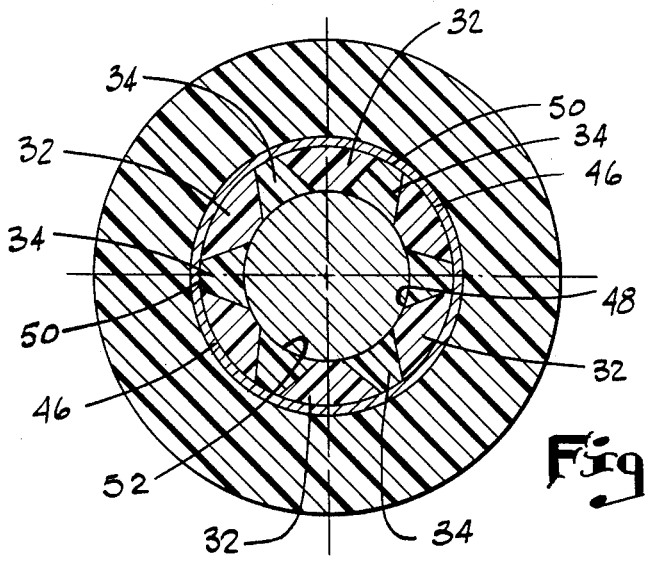
FIG. 7 is a plan view looking down from the line 7—7 on FIG. 1.

The collapsible mandrel 28 is illustrated in a collapsed condition in FIG. 6 and in an expanded or operational condition in FIG. 7. The fingers 32 and 34 are joined to the body portion 30 so that they are resiliently urged into the collapsed condition of FIG. 6. The fingers 32 have a cross-sectional configuration so that each outer surface 46 is an arc of a circle and each inner surface 48 is a portion of a surface having a configuration of a frustum of a cone. The fingers 34 have a cross-sectional configuration so that each outer surface 50 is an arc of a circle and each inner surface 52 is a portion of a surface having a configuration of a frustum of a cone. The outer surfaces 46 and 50 are arcs of the same circle and the inner surfaces 48 and 52 are portions of the same frustum of a cone for purposes described below.

Means 54 are provided for expanding the collapsible mandrel 28 and comprise an elongated member 56 having a central body portion 58, and end portion 60 and a mounting portion 62. Means 64 are provided for reciprocating the elongated member 56 in directions generally parallel to the longitudinal axis 6. The means 64 comprise a member 66 positioned in the mounting portion 62 so that there may be relative movement therebetween, a rotatable cam follower 68 mounted on the member 66 and a barrel cam 70 having a cam surface 72 for guiding the movement of the rotatable cam follower 68. The mounting portion 62 has generally cylindrical outer surface 74 except for a generally rectangularly shaped recess 80 formed in the mounting portion 62 between the spaced apart portions 76 and 78. The member 66 is located for movement in the recess 80 and is connected to the portion 78 by a spring 82. The mounting portion 62 is located within a cylinder 84 having a cylindrical inner surface 86. The cylinder 84 is secured to the work station 8 by suitable means (not shown). The cylinder 84 has a longitudinally extending opening 88 therein through which portion of the mounting portion 62 including the member 66 and the portions 76 and 78 project and as described below are mounted for reciprocation therein.

The central body portion 58 passes through an opening 90 in the plate 42. The end portion 60 has an outer surface 92 having a configuration of a frustum of a cone with the smallest diameter thereof adjacent to the end thereof removed from the central body portion 58. The end portion 60 is reciprocated by the mounting portion 62 in directions generally parallel to the longitudinal axis 6 into and out of contact with the inner surfaces 48 and 52 of the fingers 32 and 34. When the fingers 32 and 34 have been expanded as illustrated in FIG. 7, the inner surfaces 48 and 52 form a frustum of a cone that mates with the outer surface 92 of the end portion 60. As explained below, the fingers 32 and 34 are being resiliently urged in a radially outward direction by the spring 82 when they are in the expanded condition illustrated in FIG. 7.

An annular recess 94 is formed in the block 24 with the longitudinal axis of the recess coinciding with the longitudinal axis of the bore 26 and the collapsible mandrel 28. A metal control ring 96 is mounted in the annular recess 94 and forms one fixed wall thereof while a generally cylindrical surface 98 forms a second fixed wall for the annular recess 94. A resilient, deformable object 100 is mounted in the annular recess 94 and has a surface 102 in contact with a surface 104 of the metal control ring 96 and a surface 106 in contact with the generally cylindrical surface 98. In a preferred embodiment of the invention, the resilient, deformable object 100 is formed from urethane having a durometer between about 85 to 95 Shore A. The inner surface 108 of the metal control ring 96 and the inner surface 110 of the resilient, deformable object 100 are generally cylindrical and have diameters substantially the same as the diameter of the outer cylindrical surface 111 of the can body 12. An annular ring shaped member 114 is mounted for sliding movement in the annular recess 94 and has an outer diameter slightly less than the diameter of the generally cylindrical surface 98 and an inner diameter slightly less than the inner diameters of the resilient, deformable object 100 and the metal control ring 96. The annular ring shaped member 114 has a surface 116 in contact with a surface 118 of the resilient, deformable member 100. An integral flange 120 projects outwardly from the annular ring shaped member 114.

Means 122 are provided for moving the annular ring shaped member 114 in directions parallel to the longitudinal axis 6. The means 122 comprise a cylinder 124 formed in the block 24. The longitudinal axis of the cylinder 124 is parallel to the longitudinal axis 6. A piston 126 is mounted for reciprocation in the cylinder 124 and is moved by fluid passing through the ports 128 and 130. A piston rod 132 is connected at one end to the piston 126 and at its other end to the flange 120 by suitable means, such as the threaded connection 134. Therefore, the annular ring shaped member 114 moves in response to the movement of the piston 126.

The operation of a preferred embodiment is illustrated generally in FIG. 1 which shows the apparatus at two different locations. In FIG. 1, the two locations are spaced apart at 180 degrees, but this is for illustration purposes only since the locations may actually be spaced apart more or less than 180 degrees. As illustrated on the right hand side of FIG. 1, a can body 12 has been positioned on the chuck locator means 14 of a work station 8 by conventional apparatus (not shown). The means 54 for expanding the mandrel 28 are not in contact with the mandrel 28 so that it is in a collapsed condition. The piston 126 is also in an out location so that the surface 116 of the annular ring shaped member 114 is in contact with the surface 118 of the resilient, deformable object 100, but is not applying pressure thereto. The left hand side of FIG. 1 illustrates the location of the various parts immediately after the neck and flange have been formed. It is understood that the work station 8 on the left hand side of FIG. 1 is not the same work station 8 as on the right hand side of FIG. 1. However, each work station 8 will be in the illustrated positions of FIGS. 2–5 during its cycle of operation.

Figure 2:
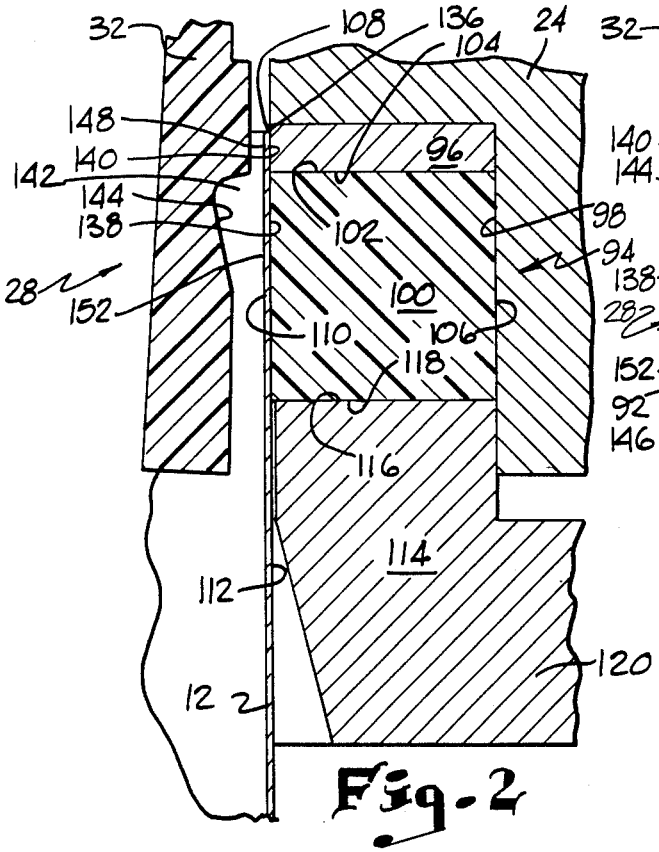
FIGS. 2–5 are enlarged elevational views with parts in section of a portion of FIG. 1 and illustrating the relative location of various parts of the invention at different stages of the necking and flanging operation.

FIGS. 2–5 illustrate the relative location of the various parts of the apparatus as the starwheel 2 rotates around its longitudinal axis 6 to move each work station 8 in a circular path. In FIG. 2, the starwheel has been rotated so that the cam follower 18 has moved the chuck locator means 14 to move the can body 12 so that the portion of the can body 12 adjacent to its open end 136 is located between a portion of the mandrel 28 and portions of the metal control ring 96, the resilient, deformable object 100 and the annular ring shaped member 114. The outer cylindrical surface 138 of the portion of the can body 12 adjacent the open end 136 is in contact with the inner cylindrical surface 108 of the metal control ring 96 and the inner cylindrical surface 110 of the resilient, deformable object 100.

Figure 3:
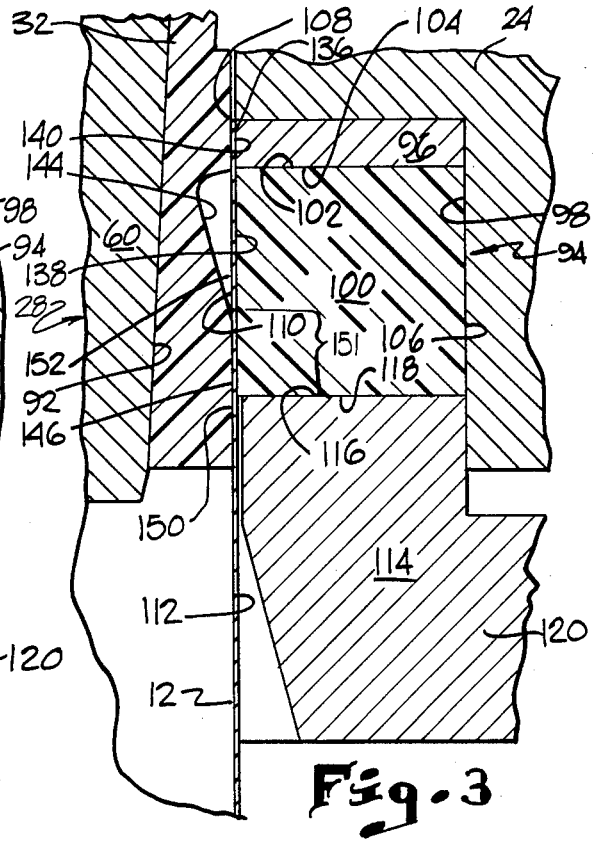
Figure 4:
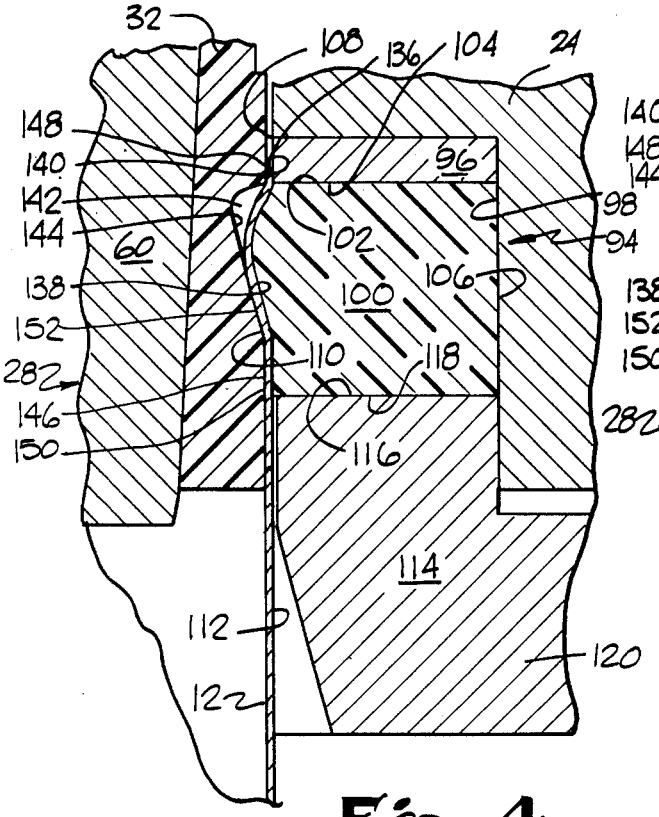

As the starwheel 2 continues to rotate around its longitudinal axis 6, the cam follower 68 moves the means 54 for expanding the mandrel 28 so that the outer surface 92 of the end portion 60 is moved into contact with the inner surfaces 52 of the movable fingers 34. As the movement of the end portion 60 is continued, the fingers 34 act on the fingers 32 so that the fingers 32 and 34 are expanded in a radially outward direction. The movement of the end portion 60 is continued until the inner surfaces 48 and 52 are in contact with and substantially conform with the outer surface 92 of the end portion 60. At this time, the outer surfaces 46 and 50 of the movable fingers 32 and 34 are in contact with the inner surface 112 of the can body 12. As illustrated in FIG. 3, the movable fingers 32 and 34, when in the expanded condition, have an outer surface configuration having a first portion comprising a generally cylindrical surface 140, an annular recess 142 having a surface 144 having a configuration corresponding to the desired shape of the surface configuration to be formed on the can body 12 such as the neck and flange for the can body 12 in the preferred embodiment and a second portion comprising a generally cylindrical surface 146. The generally cylindrical surface 140 is in contact with a third part 148 of the portion of the can body 12 radially opposite to the first portion and adjacent to the open end 136. As illustrated in the left side of FIG. 1, when the mandrel 28 is in the fully expanded position, the spring 82 is in a partially compressed condition so that it is applying a force on the third part 148 of the can body 12 located between the generally cylindrical surface 140 and the metal control ring 96 to resist movement thereof. The outer surface 110 of the resilient, deformable object 100 is radially opposite the annular recess 142 and a portion of generally cylindrical surface 146 with a portion 150 of the can body 12 located therebetween. The spring 82 is also applying a force on the portion 150 of the can body which has a first part 151 between a portion of the resilient deformable object and the second portion 12. However, since the surface area of contact on the portion 150 is substantially greater than the surface area of contact on the third part 148, the third part 150 has a substantially greater resistance to movement. The preferred surface area of contact on the portion 150 is between about 3.0 and 5.5 square inches and the original surface area of contact on the third part 148 when in the position illustrated in FIG. 3 is between about 0.5 and 1.2 square inches.

As the starwheel 2 continues to rotate about its longitudinal axis 6, suitable means (not shown) are actuated to start movement of the piston 126 by pumping fluid into the cylinder 124 through port 130. As described above, movement of the piston 126 produces movement of the annular ring shaped member 114 in the same direction. As illustrated in FIG. 3, the piston 126 has moved the annular ring shaped member 114 through a distance so as to deform the resilient, deformable object 100 so that a second part 152 of the can body 12 radially opposite the recess 142 has been partially moved into the recess 142. The force applied by the resilient, deformable object 100 on the second part 152 is less than the force being applied on the portion 150 by the spring 82 but greater than the force being applied on the portion 148 by the spring 82. Therefore, as illustrated in FIG. 3, as the resilient, deformable object 100 is deformed, the portion 150 of the can body 12 remains in a relatively fixed position while the second and third parts 152 and 148 are moved by the force being applied on the second part 152 by the deformation of the resilient, deformable object 100. The force applied by the spring 82 on the portion 148 functions to prevent the formation of wrinkles in the second and third parts 148 and 152 as the neck and flange is produced in the can body 12. Also, as a result of this force, the second and third parts 148 and 152 are stretched and thinned as the neck and flange are being formed.

Figure 5:
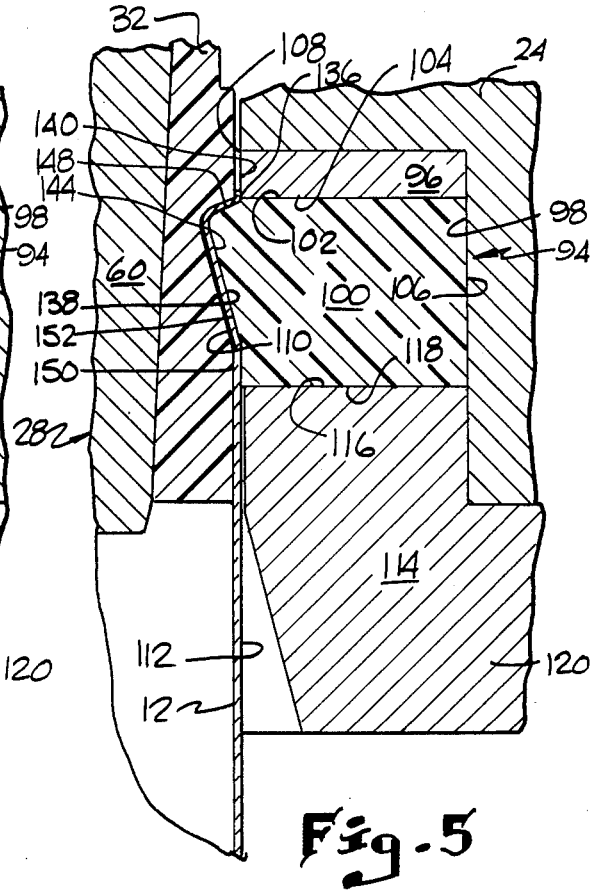

FIG. 5 is an enlarged view of a portion of the left hand side of FIG. 1 and illustrates the location of the various parts immediately after the neck and flange have been formed. The force applied by the deformation of the resilient, deformable object 100 has moved the second and third parts 148 and 152 of the can body 12 into conformation with the surface 144 of the recess 142.

As illustrated in FIG. 5, the flange, in accordance with the invention, may be formed so as to extend at an angle between about 75 degrees and 80 degrees to the side wall of the can. In most instances, this angular relationship is satisfactory for further operations such as filling the can with a beverage and capping the filled can. However, if a steeper angle closer to 90 degrees is desired, this could be accomplished in another apparatus or during the can filling operation.

As the starwheel 2 continues to rotate around the longitudinal axis 6, suitable means (not shown) are actuated to start movement of the piston 126 in the opposite direction by pumping fluid into the cylinder 124 through port 128. This causes similar movement of the annular ring shape member 114 in a direction away from the resilient, deformable member 100. The resilient characteristic of the resilient, deformable member 100 causes it to return to the shape illustrated in FIGS. 2 and 3 from the shape illustrated in FIG. 5. The continued rotation of the starwheel 2 causes cam follower 68 to move the means 54 so that the surface 92 is moved out of contact with the inner surfaces 48 and 52 of the movable fingers 32 and 34. The resilient nature of the movable fingers 32 and 34 causes them to move in a radially inward direction into a collapsed condition as illustrated in the right hand side of FIG. 1 and as illustrated in FIGS. 2 and 6. The continued rotation of the starwheel 2 causes cam follower 18 to move the chuck locator means 14 and therefore the can body 12 back to a location similar to that of the right side of FIG. 1 so that it may be removed from the work station 8 by conventional means (not shown).

Figure 8:
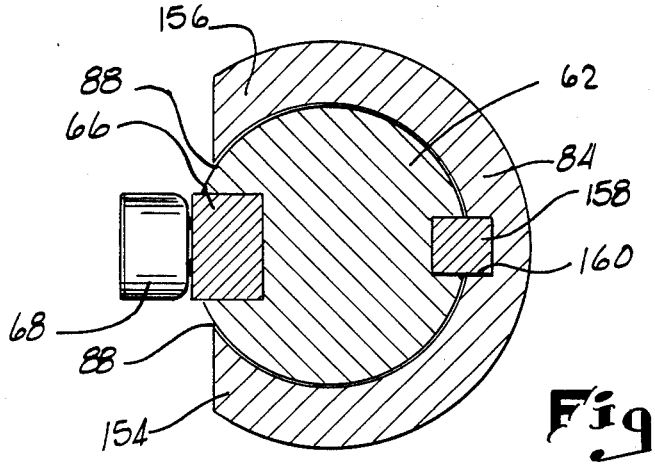
FIG. 8 is a cross-sectional view on the line 8—8 of FIG. 1.

In FIG. 8, there is illustrated the means for guiding the mounting member 62 during the reciprocation thereof while preventing relative rotation between the mounting member 62 and the cylinder 84. The opening 88 in the cylinder 84 extends for an arcuate distance of about 90 degrees so that a portion of the mounting member 62 including the member 66, the portions 76 and 78 and the cam follower 68 project outwardly therethrough. The portions 154 and 156 of the cylinder 84 adjacent to the opening 88 function to hold the mounting member 62 within the cylinder 84 and to guide it in a reciprocal path. A key way 158 extends in a longitudinal direction throughout the cylinder 84. A key 160 is secured to the mounting member 62 and a portion of the key 160 is located in the key way 158. The key 160 and the key way 158 function to prevent relative rotational movement between the mounting member 62 and the cylinder 84 during the reciprocation of the mounting member 62.

It is contemplated that the inventive concepts herein described may be variously otherwise embodied and it is intended that the appended claims be construed to include alternative embodiments of the invention except insofar as limited by the prior art.

What is claimed is:

1. Apparatus for forming a surface configuration on a can body having an open end, a closed end and a generally cylindrical inner and outer surface comprising:

a resilient, deformable object;

means for mounting said resilient, deformable object in a relatively fixed location;

a collapsible mandrel having an operational position and a non-operational collapsed position;

at least a portion of said mandrel having in its operational position a generally cylindrical outer surface;

an annular recess formed in said generally cylindrical outer surface with a first portion of said generally cylindrical outer surface located an one side of said annular recess and second portion of said generally cylindrical outer surface located on the other side of said annular recess;

said annular recess having a surface configuration corresponding to the surface configuration to be formed on a can body having an open end, a closed end and a generally cylindrical inner and outer surface;

means for positioning said can body around said mandrel when in said non-operational collapsed position so that, when said mandrel is moved to said operational position, parts of said generally cylindrical inner surface of said can body are located radially opposite said first and second portions and said annular recess;

moving means for moving said collapsible mandrel from said non-operational collapsed position to said operational position with said open end of said can body radially opposite to at least a portion of said first portion;

said resilient, deformable object being located radially opposite to said annular recess and at least a portion of said second portion;

force applying means for applying a force to said resilient, deformable object, when said collapsible mandrel is in its operational position, to deform said resilient, deformable object in radially inward directions and into contact with an adjacent portion of said generally cylindrical outer surface of said can body;

said force applying means deforming said resilient deformable object to apply a restraining force on a first part of said parts of said body located between said resilient, deformable object and said at least a portion of said second portion so as to prevent axial movement of said first part;

said force applying means applying a sufficient force to said resilient, deformable object so as to deform said resilient, deformable object to apply a force against a second part of said parts of said can body radially opposite to said annular recess to move said second part and a third part of said parts of said can body radially opposite to said first portion in both radially inward and axial directions and into contact with said surface of said annular recess;

said means for moving said collapsible mandrel from said non-operational collapsed position to said operational condition including resilient force applying means for applying resilient radially outwardly directed forces on said first and second portions of said collapsible mandrel; and said first portion applying substantially circumferentially continuous, radially outwardly directed forces on said third part of said can body to resist axial movement thereof so that said said second and third parts of said can body are stretched and thinned as they are moved by said resilient, deformable object into contact with said surface of said annular recess.

2. Apparatus as in claim 1 wherein said collapsible mandrel comprises:

a plurality of movable fingers;

each of said fingers having an outer surface which is an arcuate segment of said mandrel in its operational condition;

said moving means moving said movable fingers in a radially outward direction into said operational condition.

3. Apparatus as in claim 2 and further comprising:

a rigid element mounted in a fixed position axially adjacent to said resilient, deformable object;

said rigid element having a generally cylindrical inner surface having a diameter substantially the same as the diameter of said generally cylindrical outer surface of said can body; and said inner surface of said rigid element being radially opposite to said first portion so that said third part of said can body is located therebetween.

4. Apparatus as in claim 1 wherein said means for mounting said resilient, deformable object in a relatively fixed location comprises:

a member mounted in a relatively fixed location;

said member having an opening extending therethrough;

at least a portion of s aid opening having a generally cylindrical inner surface having a longitudinal axis;

an annular recess in said at least a portion of said opening;

said recess comprising two relatively fixed walls, one movable wall, mounted for reciprocal movement in directions generally parallel to said longitudinal axis, and an opening facing in a radially inward direction;

at least a portion of said movable wall having a generally cylindrical inner surface;

said resilient, deformable object seated in said recess and having an inner surface thereof facing in said radially inward direction.

5. Apparatus as in claim 4 wherein said force applying means comprises:

reciprocating means for applying a force to said movable wall to move said movable wall against said resilient, deformable object to deform said resilient; deformable object.

6. Apparatus as in claim 5 wherein said reciprocating means comprises:

an annular flange portion extending radially outwardly from said movable wall;

a cylinder formed in said member;

a piston mounted for reciprocal movement in said cylinder;

inlet and outlet means for introducing a fluid under pressure in said chamber to reciprocate said piston; and means for connecting said annular flange portion to said piston for reciprocal movement therewith.

7. Apparatus as in claim 6 and further comprising:

a rigid element mounted in a fixed position axially adjacent to said resilient, deformable object;

said rigid element having a generally cylindrical inner surface having a diameter substantially the same as the diameter of said generally cylindrical outer surface of said can body; and said inner surface of said rigid element being radially opposite to said first portion so that said third part of said can body is located therbetween.

8. Apparatus as in claim 7 wherein said collapsible mandrel comprises:

a plurality of movable fingers;

each of said fingers having an outer surface which is an arcuate segment of said mandrel in its operational condition;

said moving means moving said movable fingers in a radially outward direction into said operational condition.

9. Apparatus as in claim 7 wherein said resilient, deformable object comprises:

a ring shaped member formed from urethane.

10. A method for forming a surface configuration on a can body having an open end, a closed end and a generally cylindrical inner and outer surface comprising:

means for mounting a resilient, deformable object in a relatively fixed location;

providing a collapsible mandrel having an operational position and a non-operational collapsed position with at least a portion of said mandrel having in its operational position a generally cylindrical outer surface having an annular recess formed therein with a first portion of said generally cylindrical outer surface located on one side of said annular recess and a second portion of said generally cylindrical outer surface located on the other side of said annular recess;

forming said annular recess with a surface configuration corresponding to the surface configuration to be formed on a can body having an open end, a closed end and a generally cylindrical inner and outer surface;

positioning said can body around said mandrel when in said non-operational position so that when said mandrel is moved to its operational position parts of said generally cylindrical inner surface of said can body are located radially opposite said first and second portions and said annular recess;

moving said collapsible mandrel from its non-operational collapsed position to an operational position with said open end radially opposite at least a portion of said first portion;

locating said resilient, deformable object so that it is radially opposite to said annular recess and at least a portion of said second portion;

applying a force to said resilient, deformable object, when said collapsible mandrel is in its operational position, to deform said resilient, deformable object in radially inward directions and into contact with an adjacent portion of said generally cylindrical outer surface of said can body;

applying a force on a first part of said parts of said can body located between said resilient, deformable object and said at least a portion of said second portion by the continued deformation of said resilient, deformable object so as to prevent axial movement of said first part;

applying sufficient force to said resilient, deformable object so as to continue the deformation of said resilient, deformable object to move it against a second part of said parts of said can body radially opposite to said annular recess to move said second part and a third part of said can body radially opposite to said first portion in both radially inward and axial directions and into contact with the surface of said annular recess;

applying resilient radially outwardly directed forces on said first and second portions of said collapsible mandrel; and using said first portion to apply substantially circumferentially continous, radially outwardly directed forces on said third part of said can body to resist axial movement thereof so that said second and third parts of said can body are stretched and thinned as they are moved by said resilient, deformable object into contact with said surface of said annular recess.

11. A method as in claim 10 and further comprising:

forming said resilient, deformable object as a ring shaped member; and using urethane to form said ring shaped member.

* * * * *